US005379963A

United States Patent [19]

Stauber

[11] Patent Number: 5,379,963

[45] Date of Patent: Jan. 10, 1995

[54] PROCESS AND APPARATUS FOR CHANGING, TRANSFERRING AND TEMPORARILY STORING PRINTED PRODUCT ROLLS

[75] Inventor: Hans-Ulrich Stauber, Grüt, Switzerland

[73] Assignee: Ferag AG, Hinwil, Switzerland

[21] Appl. No.: 922,504

[22] Filed: Jul. 31, 1992

[30] Foreign Application Priority Data

Aug. 13, 1991 [CH] Switzerland ..... 02400/91-7

[51] Int. Cl.[6] ..... B65H 19/12; B65H 19/30

[52] U.S. Cl. ..... 242/533.8; 242/559

[58] Field of Search ..... 242/586, 59, 58, 79

[56] References Cited

U.S. PATENT DOCUMENTS

| | | | |
|---|---|---|---|
| 4,537,368 | 8/1985 | Radmore et al. | 242/58.6 |
| 4,601,436 | 7/1986 | Honegger | 242/59 |
| 4,682,743 | 7/1987 | Tokuno et al. | 242/58.6 |
| 4,769,973 | 9/1988 | Reist | 242/59 |
| 4,898,336 | 2/1990 | Reist | 242/586 X |

FOREIGN PATENT DOCUMENTS

| | | |
|---|---|---|
| 0311869 | 4/1989 | European Pat. Off. . |
| 3602320 | 8/1986 | Germany . |

*Primary Examiner*—Daniel P. Stodola
*Assistant Examiner*—John Q. Nguyen
*Attorney, Agent, or Firm*—Walter C. Farley

[57] ABSTRACT

Product to be removed from winding stations (full rolls from winding-up stations, roll cores from winding-off stations) are deposited by a manipulation/transportation device on a transfer mechanism (20.1) and are transported from there with a manipulation/transportation vehicle (30) to a storage location. Product to be introduced at the winding stations (empty roll cores for the winding-up station, full rolls for the winding-off station) are transported by the same manipulation/transportation vehicle (30) from a storage location to the transfer mechanism and are deposited there and are introduced at the winding station by the manipulation/transportation device. The transfer mechanism (20.1) is designed in such a way that the manipulation/transportation vehicle (30) can deposit the product to be introduced from a single position and can take up the product to be removed. Between the two operations it is merely necessary for the manipulation tool to perform a single translatory movement. A forklift truck is used as the manipulation/transportation vehicle and in each case two rolls are placed on a pallet (40) and in each case two roll cores are stored on a pallet as storage units. Such a storage unit is transported to the transfer mechanism (20.1) being rotated by ±90° and deposited there without the pallet (40). The pallet is moved with the forks of the forklift to the product to be removed in the transfer mechanism, is transported away with the latter by said mechanism and the forks are again rotated by ±90° and introduced as a storage unit together with the product to be removed.

23 Claims, 7 Drawing Sheets

PROCESS AND APPARATUS FOR CHANGING, TRANSFERRING AND TEMPORARILY STORING PRINTED PRODUCT ROLLS

FIELD OF THE INVENTION

The invention is in the field of the further processing of printed products and relates to a process and an apparatus are used for the changing, transferring and intermediate or temporary storage of printed product rolls or reels.

BACKGROUND OF THE INVENTION

In the prior art printed products, preferably folded printed products, which have been brought into a scale formation by any previous processing stage, such as a rotary press and which are to be temporarily stored prior to the following processing stage, are passed to a winding station (with a winding-up function), where they are wound onto a roll core with the aid of a winding band. The resulting rolls are temporarily stored in vertical or horizontal manner with or without storage assistance means, such as pallets and when required are supplied to a winding station (with an unwinding function), where they are unwound and supplied in scale formation again to a further processing stage.

Winding stations for the winding up or off of printed products in scale formation are described in European patents 161569, 230677 and 281790 (U.S. Pat. Nos. 4601436, 4769973 and 4898336), assigned to the assignee of the present application, or in Swiss patent applications 791/90 and 3128/90, also assigned to the assignee of the present application. These stations are designed in such a way that they are always processing, i.e. winding up or off one roll, while a second roll is being changed. Manipulations and transportation between the winding station and store through which the product to be removed (full rolls from winding-up stations/empty roll cores from unwinding stations) are brought from the winding station into the store and the product to be used (empty roll cores for winding-up stations/full rolls for unwinding stations) are brought from the store to the winding station, are carried out with the assistance of various aids and methods and require either complicated equipment or complicated switching operations with manual work.

For example, use is made of displaceable magazines, which contain the roll core and the winding band and which are transported with the aid of a store vehicle between the winding station and store. Such magazines are e.g. described in Swiss patent 652699 or European patent 243837, assigned to the assignee of the present application. The magazines serve as movable apparatus as part of the winding station, as well as a transportation means and storage means. For changing or replacement purposes a magazine must be accurately positioned at the winding station and then serves as part of the latter. Magazines with product to be removed or introduced are transported with a transportation vehicle to or away from the store and are introduced into or removed from the latter. Such a process requires a separate magazine for each roll or roll core to be stored and a relatively large storage location is required for each magazine. However, with regards to equipment and shape no special demands must be made on the storage location and the overall store can also be formed from any random free locations which are large enough for a magazine. A large amount of space is also required in the vicinity of the winding stations, because at the time of magazine change at least two magazines must always be deposited there (cf. also description regarding FIG. 2) and the vehicle with the magazines must be maneuverable there. The working process with the magazines is not only complicated, but can scarcely be automated, but has the advantage that there is no need for a specially equipped storage area and only one transportation means has to be used between the winding station and the store, i.e. the product to be introduced and removed does not have to be "transferred" from one transportation means to another.

In order to simplify such complicated operations and make automation possible, roll changing and storing processes have been developed, in which the product to be removed is removed from the winding station by a manipulating/transportation means and is deposited on a stationary transfer mechanism, where it is e.g. fetched by a shuttle vehicle travelling on a rail. The product to be introduced is brought by the same shuttle vehicle onto the stationary transfer mechanism and is deposited there and is then brought to the winding station by the manipulation/transportation means. The latter is generally constituted by an automated travelling crane. With a corresponding design of the transfer mechanism and the shuttle vehicle it is possible with only two positioning steps on the part of the vehicle to deposit the product to be introduced and take up the product to be removed. Such processes and apparatuses are e.g. described in Swiss patent application 888/91, assigned to the assignee of the present application and in DE-OS 3602320 (Grapha-Holding AG).

Processes with stationary transfer mechanisms, manipulation/transportation means between the winding station and transfer mechanism and shuttle vehicles between the transfer mechanism and the store, which can serve several winding stations moving on a rail, compared with the aforementioned processes with magazines save a considerable number of transportation paths, numerous maneuverable and various manipulating movements and can therefore be more easily automated. However, they are more complicated with respect to the necessary equipment and in particular the storage location. The store must either be equipped with storage means similar to the transfer mechanisms, i.e. it is no longer possible for it to be formed from various locations as and when they become available and it must be accessible to the shuttle vehicle, i.e. must be close to and reachable from a rail (DE-OS 3602320). Alternatively the product to be removed and introduced must be transferred to a further store vehicle or mechanism for storage on a further transfer location (Swiss application 888/91).

SUMMARY OF THE INVENTION

An object of the invention is to provide a process having the advantages of the aforementioned processes for the changing and temporary storage of printed product rolls to be combined while bringing about maximum elimination of their disadvantages. According to the inventive process, which can be applied to both winding-up and winding-off stations, roll changes and temporary storage operations are to be performed with minimum transportation paths, maneuvering operations and manipulating movements. According to the invention process, full rolls and empty roll cores are to be manipulated in the same way and without mechanical aids and it is possible to store rolls and cores with a single transfer maneuver at a storage location, where there are minimum requirement, as regards size and no requirements as regards equipment and position. As the process is intended to offer maximum freedom with respect to the storage location, the process is little automated, but still performable with a minimum of personnel and vehicles.

A further object of the invention is to provide a transfer mechanism for performing the inventive process permitting, between the winding station and store, the making available of printed product rolls and roll cores in correct manipulation manner and for a roll-side and store-side manipulation/transportation means. The transfer mechanism must be simple, favorable to manufacture and space-saving.

The central idea of the invention is to provide a stationary transfer mechanism associated with at least one winding station and on which, for the case of the winding-up station, full rolls (product to be removed) from the station and empty cores (product to be introduced) from a store and, in the case of a winding-off station empty cores (product to be removed) from the station and full rolls (product to be introduced) from a store can be deposited in such a way that a substantially commercially available manipulation/transportation vehicle, which brings the product to be introduced from a store, only has to be accurately positioned once in the vicinity of the transfer mechanism for interchanging the product to be introduced against the product to be removed using a single translatory and preferably linear movement of its manipulating tool. The manipulation/-transportation vehicle can e.g. be a commercially available forklift truck, whose forks can be moved toward and away from each other for gripping/releasing and can be moved jointly in at least the vertical direction for manipulation purposes.

The loading of the transfer mechanism with product to be removed from the winding station and the loading of the winding station with product to be introduced from the transfer mechanism is e.g. performed with the aid of a travelling crane and can be fully automated. However, the manipulation/transportation vehicle bringing the product to be introduced to the transfer mechanism and the product to be removed from the latter is operated manually. In this way the manipulation/transportation vehicle can move up to any desired available storage location in order to deposit or grip a load.

Therefore the inventive process links the advantage of a simple change in accordance with the storage process using the shuttle vehicle with the advantage of a not specially equipped and a not specially located storage location according to the storage process with magazines. The inventive process can carry out roll changes and storage with a single transfer maneuver, but by means of a further transfer maneuver can be combined with more complicated, e.g. fully automated storage processes. There is a minimum space requirement in the vicinity of the winding stations.

The inventive transfer mechanism essentially comprises a frame with a location for at least one full roll and at least one empty roll core. The two locations are positioned in such a way that on the one hand (winding station side) they can be reached from the winding station travelling crane and on the other (store side) from the manipulation tool of the manipulation/transportation vehicle and namely from the same vehicle position. The two locations are so positioned that the manipulation tool of the manipulation/transportation vehicle only has to be moved in a single direction between the depositing of the product to be introduced and the gripping of the product to be removed.

BRIEF DESCRIPTION OF THE DRAWINGS

The inventive process and transfer mechanism are described in greater detail hereinafter relative to the drawings, wherein.

DETAILED DESCRIPTION OF THE PREFERRED EMBODIMENTS

Figure 1:
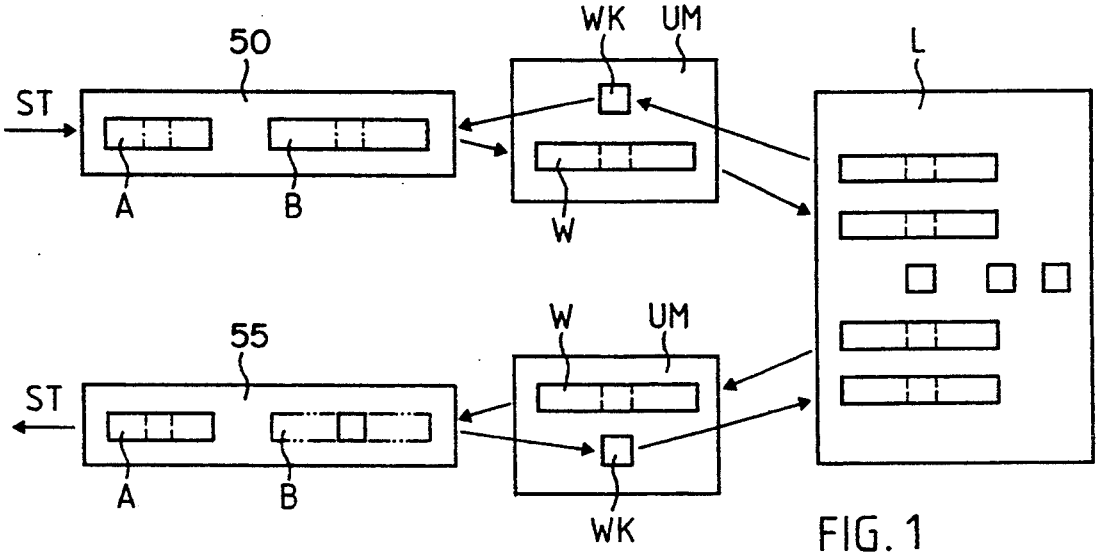
FIG. 1 PRIOR ART
FIG. 1 is a schematic diagram showing a general process for changing and temporarily storing printed product rolls with winding-up and winding-off stations.

FIG. 1 diagrammatically shows a general process for the changing, transferring and temporary storing of printed product rolls W and roll cores WK with a winding-up station 50 entered by a scale flow ST and a winding-off station 55 exited by a scale flow ST. Both winding stations have winding positions A and B for two rolls, whereof one (position A in the drawing) can be wound up or off, while the other (position B in the drawing) is changed. In position B of the winding-up station a full printed product roll W (product to be removed) is replaced by an empty roll core WK (product to be introduced) and in the winding-off station 55 an empty roll core WK (product to be removed) is replaced by a full roll W (product to be introduced). The product to be removed is transported from the winding station 50 or 55 to a store L and is stored there, while the product to be introduced is removed from the store L and transported to the winding station 50 or 55. Between the winding station and the store, advantageously closer to the former, is provided at least one transfer location UM associated with one or more winding stations and on which the product to be introduced and removed is temporarily deposited. The manipulation add transportation of the rolls and roll cores between the winding station and the transfer locations are advantageously performed by a fully automatable manipulation/transportation means, e.g. a travelling crane. The manipulation and transportation of rolls and roll cores between the transfer location and the store can be performed by any random second manipulation/transportation means. advantageously a manipulation/transportation vehicle, and it is possible to introduce a further transfer location and a third manipulation/transportation means.

Figure 2:
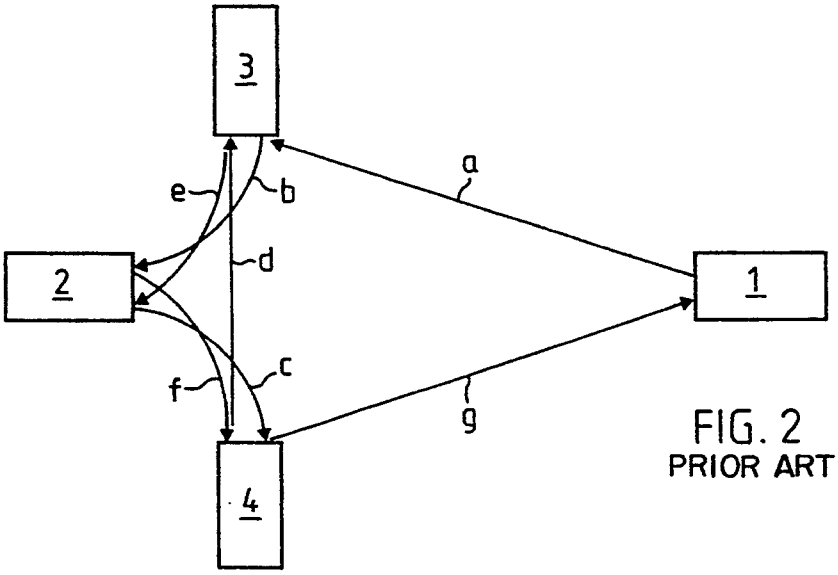
FIG. 2 PRIOR ART
FIG. 2 is a schematic diagram illustrating a process for roll-changing and temporary storage using magazines according to the prior art.

FIG. 2 diagrammatically shows the working sequence between the winding station and the store for prior art process working with magazines. Box 1 represents a random storage location. Box 2 represents a clearly defined loading/unloading location, on which the magazine is positioned and on which it serves as part of the winding station, in that a roll is wound directly onto the magazine or unwound from the same. Box 3 represents a first and box 4 a second deposit location in the vicinity of the winding station.

The working sequence for a transportation vehicle for the transportation of magazines serving to prevent empty journeys to the store is typically as follows: a: first magazine (with full rolls for the unwinding station and empty for the winding up station) is transported from the store to the deposit location 3 and deposited; b: followed by moving to the loading/unloading station, the positioning of the vehicle and the gripping of the second magazine; c: the second magazine is transported to the setting down location 4 and deposited; d: movement takes place to the setting down location 3, the vehicle is positioned and the first magazine gripped; e: the first magazine is transported to the loading/unloading station 2, the vehicle positioned and the magazine positioned; f: movement to the setting down location 4, the vehicle is positioned and the second magazine gripped and g: the second magazine is transported to the storage location. In certain circumstances it is possible by using aids to remove the second magazine manually from the loading/unloading station and to position the first magazine there, which simplifies the working sequence of the vehicle, but requires more personnel.

A process using magazines which is simpler with regards to the working sequence, but much more complicated regarding the apparatus expenditure is described in European patent 242607 assigned to the assignee of the present invention. The loading/unloading station therein is designed for two magazines and the loaded/unloaded magazine is automatically moved from the first to the second location, where it can be gripped by the transportation vehicle, after the latter has positioned the replacement magazine at the first location and deposited it.

Figure 3:
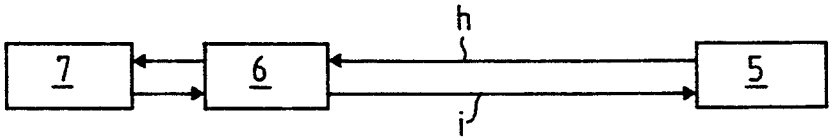
FIG. 3 is a schematic diagram illustrating the process of roll-changing and temporary storage in accordance with the invention.

FIG. 3 shows the corresponding working sequence according to the inventive process. Box 5 once again represents a random storage location, box 6 a transfer location, which is equipped with an inventive, stationary transfer mechanism and box 7 a winding station. The working sequence is as follows: h: the product to be produced is transported with the manipulation/transportation vehicle from the storage location 5 to the transfer location 6, the vehicle is accurately positioned, the product to be introduced is deposited on the transfer mechanism; i: the manipulation means of the manipulation/transportation vehicle is moved in one direction, the product to be removed is gripped and transported to the store. The transportation and manipulation between the winding station 7 and the transfer location 6 is performed completely automatically, e.g. by a travelling crane.

A comparison of FIGS. 2 and 3 shows the clear advantages of the inventive process with a stationary transfer mechanism compared with the prior art process using magazines. Another advantage which is not apparent from the drawings is that for the transportation of the rolls or roll cores according to the process of the invention a smaller manipulation/transportation vehicle, such as e.g. a forklift is sufficient, whereas a larger vehicle is required for the much heavier magazines.

Figure 4:
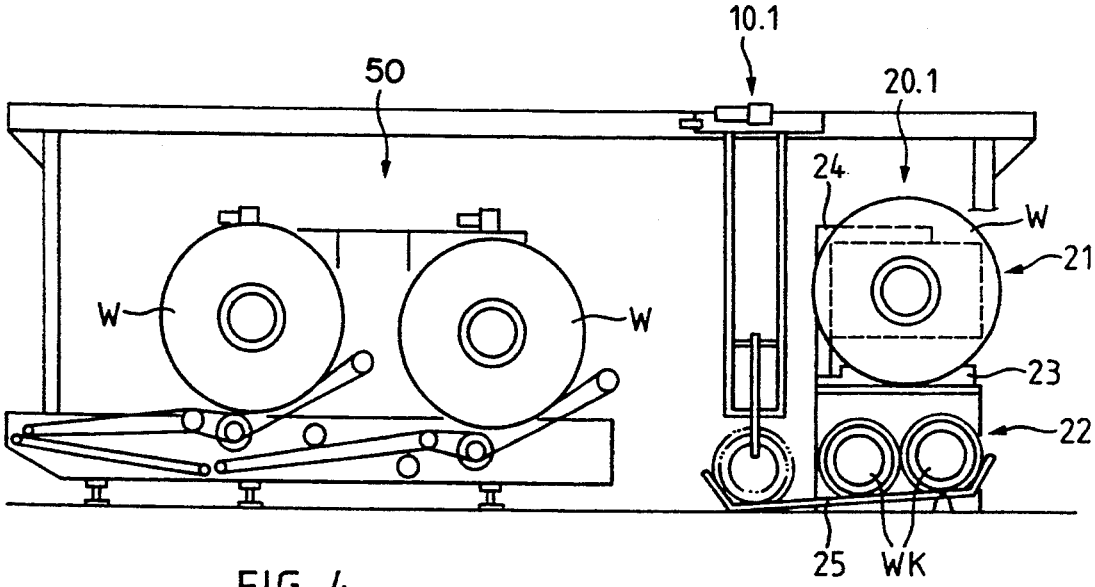
FIG. 4 is a schematic side elevation of a winding-up station showing one embodiment of a transfer mechanism in accordance with the invention.
Figure 5:
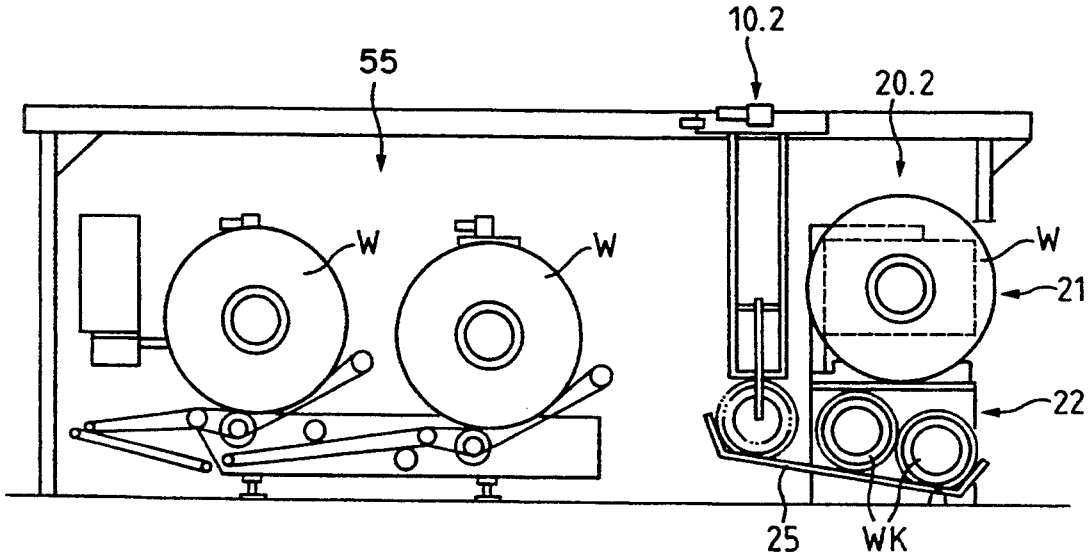
FIG. 5 is a schematic side elevation of a winding-off station showing one embodiment of a transfer mechanism in accordance with the invention.

FIGS. 4 and 5 show winding stations 50 and 55 with traveling cranes 10.1 and 10.2 for the changing or replacement of rolls and roll cores and an embodiment of the inventive transfer mechanism 20.1 and 20.2, on which the rolls W and roll cores WK are deposited at in each case one roll location 21 and one core location 22. Advantageously the transfer mechanisms are arranged in such a way that the axes of rolls deposited thereon are substantially parallel to the axes of rolls on the winding station. In the represented embodiment in each case two rolls W or two cores WK can be deposited on in each case one corresponding roll location 21 and one core location 22. It is also possible to conceive embodiments with roll and core locations, where the deposit takes place of one: roll and one core or more than two rolls and an equal number of cores.

The deposited rolls essentially have the same spatial position as the rolls on the winding station, i.e. their rotation axes are substantially horizontal. Several rolls are closely side-by-side juxtaposed on the roll location in such a way that their rotation axes lie in the same vertical plane. The deposited cores also have substantially the same spatial position on the core location as on the winding station (horizontal rotation axis) and in the case of several cores they are arranged successively in the transportation direction on a sloping plane, so that their order is automatically adjusted by gravity and they can be reliably gripped or deposited by the manipulation tool of the manipulation/transportation vehicle.

FIG. 4 shows the winding-up station 50. The travelling crane 10.1 removes in succession full Polls W from the winding-up station and deposits them in the roll location 21 of the transfer mechanism 20.1 by gripping the roll in the inner area of the roll core. The roll location is equipped with at least one double wedge 23 and a lateral support 24, so that two rolls W can be accurately positioned thereon, leaning slightly against the lateral support 24 (cf. also FIGS. 10 and 11). The core location 22 is equipped with a core guide 25 which has a stop member at one end closest to the store and, assigned to the assignee of the present application winding station side. Each stop member is inclined outwardly, the stop member at the store side being inclined toward the store and the stop member at the other end being inclined toward the winding station. Roll cores deposited in the core location 22 roll against the stop member on the winding station side, from where they are individually gripped by the travelling crane 10.1 and taken to the winding station. It is possible to see two roll cores on the core location 22 and a core shown by a dashed line which has rolled toward the winding station and abuts the winding station-side stop member of the core guide 25 and in this position can be gripped by the travelling crane 10.1.

FIG. 5 shows a winding-off station 55 with a travelling crane 10.2, corresponding to the travelling crane of FIG. 4, and an inventive transfer mechanism 20.2. Here the travelling crane removes individual roll cores WK from the winding-off station and deposits them (core shown in broken line form) on the winding station-side projecting part of the core guide 25, which in this case sinks toward the core location 22, so that the cores deposited on the core guide roll into the core location 22 and abut against the store-side stop member thereof. The two roll cores shown in continuous line form assume a position in which they can be reliably gripped by the manipulation tool of the manipulation/transportation vehicle. The travelling crane brings rolls from the transfer mechanism 20.2 to the winding-off station.

FIGS. 6A–F and 7A–F show in detail the operating process described in general terms in conjunction with FIG. 3 on the store side of the inventive transfer mechanism, i.e. the cooperation between the transfer mechanism 20.1 or 20.2 and the manipulation/transportation vehicle 30, namely for a winding-up station (FIG. 6) and for a winding-off station (FIG. 7). Both sets of drawings include a time sequence of six, relative positions of the manipulation/transportation vehicle 30 and the transfer mechanism 20.1 or 20.2. The process embodiment discussed and the corresponding embodiment of the inventive transfer mechanism relate, as in FIGS. 4 and 5, to the manipulation of in each case two rolls W and two roll cores WK.

The manipulation/transportation vehicle 30 is a commercially available forklift whose manipulation tool is constituted e.g. by two forks 31 movable toward one another and which for the represented process are juxtaposed and movable horizontally toward one another. Moreover, the entire manipulation tool (both forks together) can be moved at least in the vertical direction. The transfer mechanism 20.1 or 20.2 corresponds to that of FIGS. 4 and 5. The winding location 21 and core location 22 are freely accessible on all sides and precisely vertically superimposed.

Figure 6A:
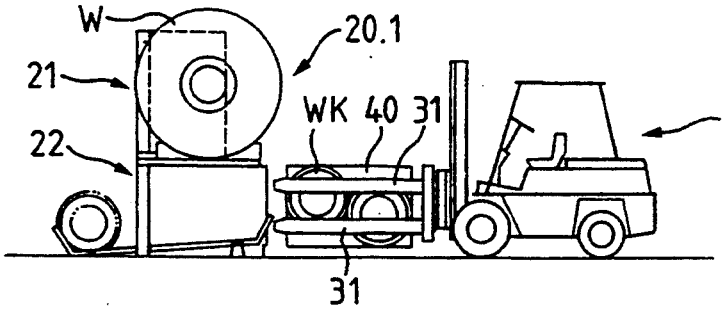
FIGS. 6A–6F are sequential schematic side elevations of a winding-up station showing the cooperation between the transfer mechanism and a manipulation and transportation vehicle in accordance with the invention.
Figure 7A:
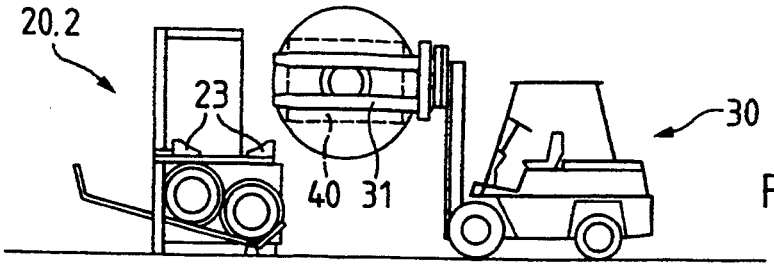
FIGS. 7A–7F are sequential schematic side elevations of a winding-off station showing the cooperation between the transfer mechanism and a manipulation and transportation vehicle in accordance with the invention.

FIGS. 6A and 7A each show the manipulation/transportation tool 30, which transports the product to be used to the transfer mechanism 20.1 or 20.2, the approach taking place from the side opposite to the winding station. As a function of the product to be introduced (roll cores WK or rolls W) the forks are oriented level with the roll location 21(FIG. 7A) or the core location 22(FIG. 6A) of the transfer mechanism. The rolls or roll cores are held by the forks in the same reciprocal position which they are to assume on the transfer mechanism, i.e. two rolls with horizontal rotation axes located in a vertical plane or two successive roll cores in the transportation direction with parallel, horizontal rotation axes.

Figure 6B:
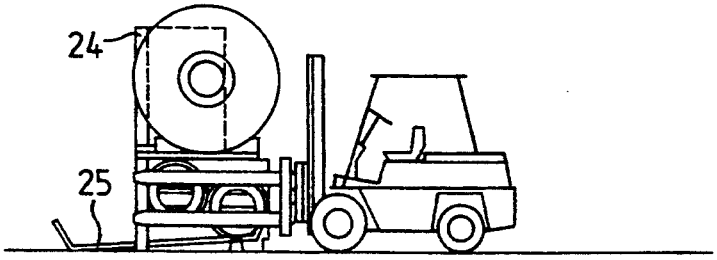
Figure 7B:
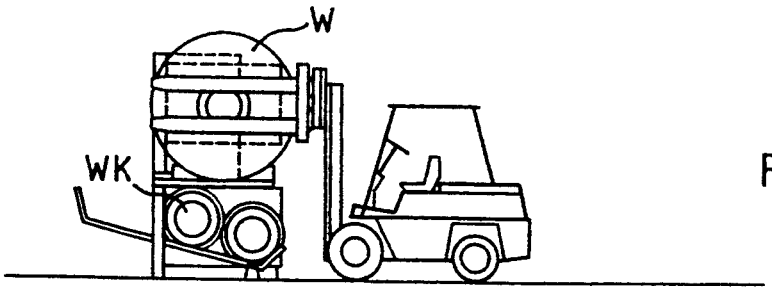

FIGS. 6B and 7B each show the introduction of the product to be introduced into the corresponding location of the transfer mechanism and for this purpose the manipulation/transportation vehicle, on abutting, is laterally oriented in an optimum manner with the transfer mechanism. If the manipulation tool is also horizontally displaceable (both forks together), the lateral position can be finely adjusted by a lateral movement of the manipulation tool. The height is adjusted by the vertical movement of the manipulation tool when the rolls are somewhat higher than the predetermined depositing position, because it is first necessary to pass over the double wedge 23 and only then can the rolls be lowered into the depositing position.

Figure 6C:
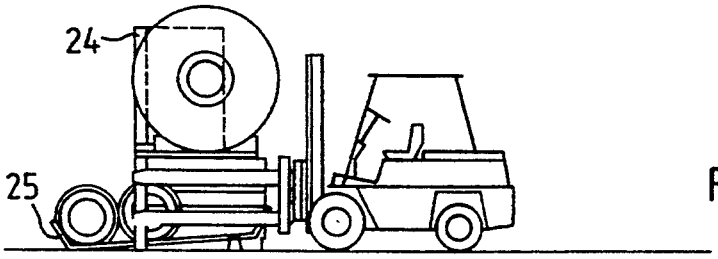
Figure 7C:
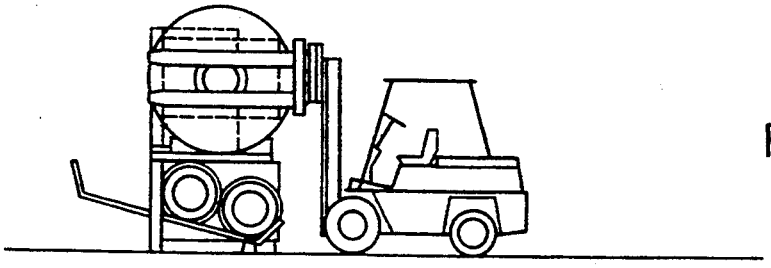

FIGS. 6C and 7C each show the deposit of the product to be introduced. For this purpose the forks are moved apart and in this way release the rolls or roll cores. The roll cores immediately roll on the core guide 25 toward the winding station. The rolls stand on the double wedges 23 and lean against the lateral support 24.

Figure 6D:
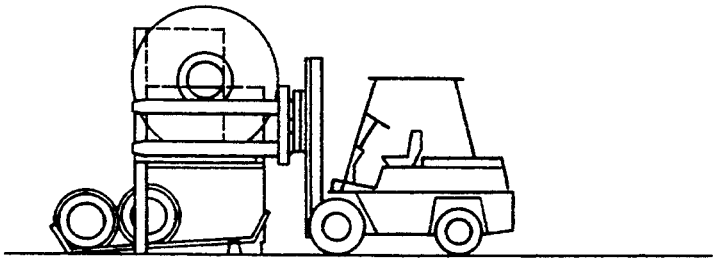
Figure 7D:
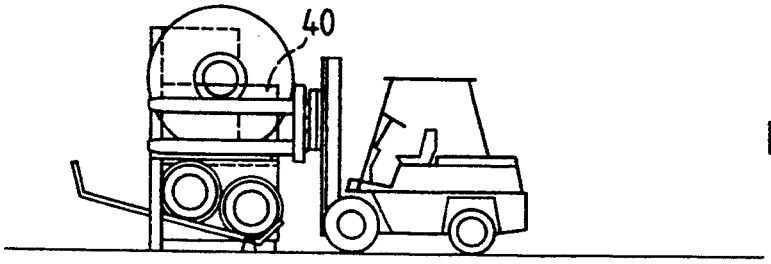

FIGS. 6D and 7D show the vertical movement of the manipulation tool in FIG. 6D towards the top and in FIG. 7D towards the bottom. This is the only maneuver which is necessary between the deposit of the product to be introduced and the gripping of the product to be removed.

Figure 6E:
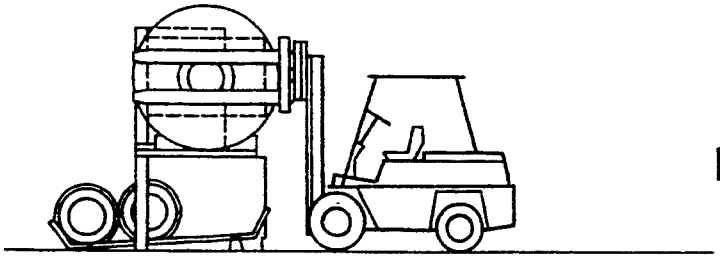
Figure 7E:
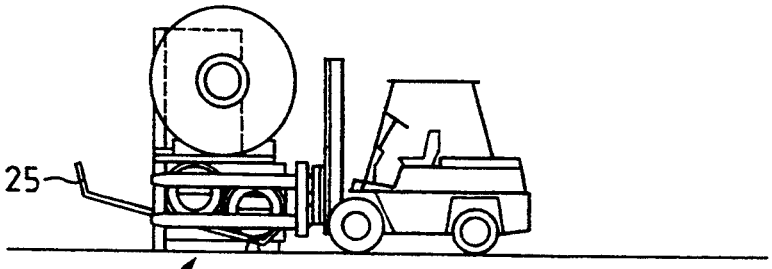

FIGS. 6E and 7E show the gripping of the product to be removed. FIG. 7E shows that the two roll cores to be removed are deposited by a corresponding design of the core guide 25 in the core location 22 in such a way that they can be reliably taken up by the forks.

Figure 6F:
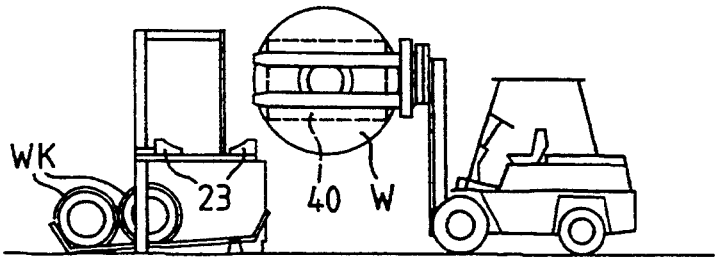
Figure 7F:
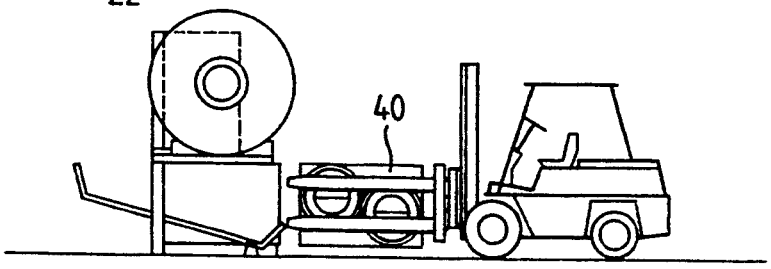

FIGS. 6F and 7F show the manipulation/transportation vehicle moving away with the product to be removed.

The shape of the forks 31 of commercial forklifts is standardized and corresponds to the shape of standardized pallets. According to a particularly advantageous embodiment of the inventive process the forklift carries with it on one of its forks a pallet, while the operating sequence shown in FIGS. 6A–F and 7A–F takes place. A standardized Europa pallet 40 is shown in dashed lines on the side of the fork remote from the viewer. The lateral support 24 is also designed in such a way that the pallet 40 does not come into conflict with it when rolls are introduced as shown in FIG. 7B.

Figure 8:
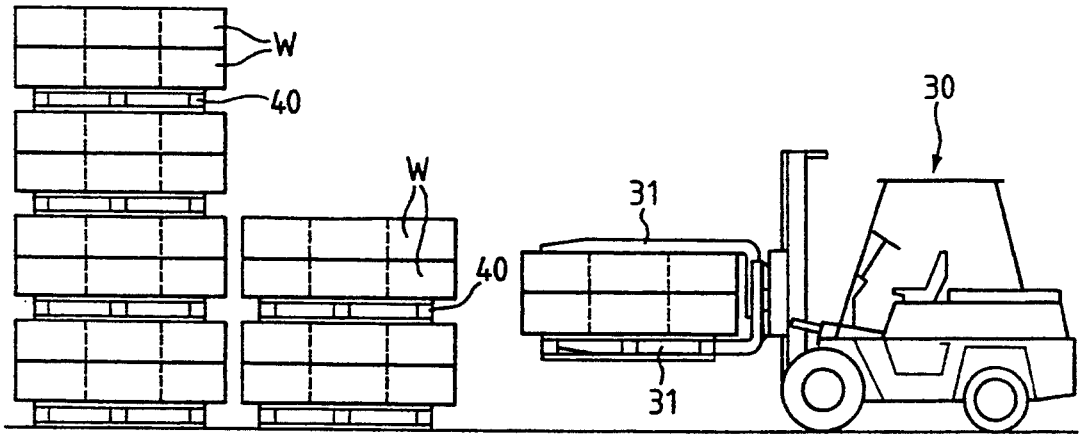
FIG. 8 is a schematic side elevation of a printed product roll store in accordance with an embodiment of the present invention.
Figure 9:
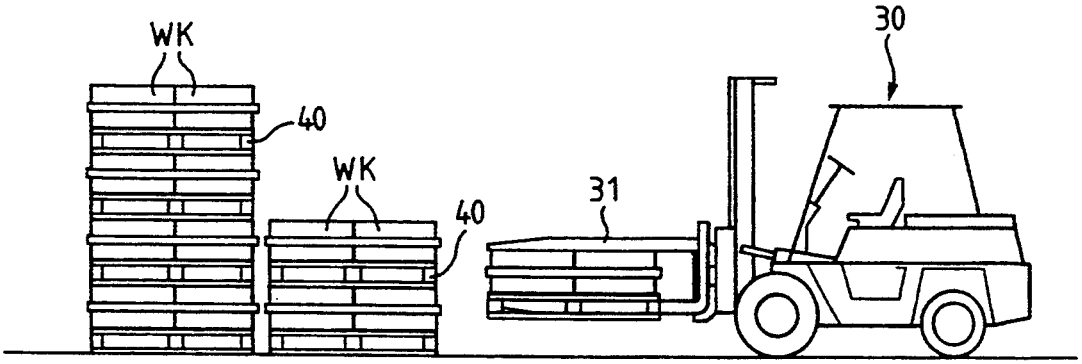
FIG. 9 is a schematic side elevation of a store for empty roll cores in accordance with an embodiment of the present invention.

FIGS. 8 and 9 show examples of stores for printed product rolls (FIG. 8) or roll cores (FIG. 9), which can be obtained with the process variant using pallets. For example, there are always two rolls W or two roll cores WK for each pallet 40. Such storage units can be stacked on one another. If such a store is to be produced, the manipulation tool of the manipulation/transportation vehicle must also be rotatable, namely by at least 90° in both directions. Therefore the manipulation/transportation vehicle necessary for this process is advantageously equipped with a manipulation tool, which by locking can grip an object, which is movable both horizontally and vertically and which is rotatable by at least 90° in both directions and such requirements can be fulfilled by commercially available forklifts and corresponding attached implements.

FIGS. 6A–F to 9 illustrate the main advantages of the inventive process, particularly in the embodiment with the pallet. The product to be introduced is raised in the store in the form of a storage unit with the pallet 40, transported to the transfer mechanism and is introduced and deposited there at the corresponding location and anywhere between the store and the transfer mechanism it can be locked and rotated by 90°. Following the position of the product to be introduced, the manipulation tool with the pallet moves in a single direction to the location of the product to be removed and grips it. The product to be removed is then transported into and deposited in the store and anywhere between the transfer mechanism and the store it can be so rotated by 90° that the pal let comes to rest at the bottom of the load.

As each pal let freed from the product to be introduced is immediately used for the product to be removed, no pallet need be deposited in the vicinity of the transfer mechanism. As the storage units (pallet plus roll or core) must have an adequate storage stability, no equipment demands need be met at the storage location. Therefore any available or desired free location can be used for storage purposes. Obviously other storage methods are possible. For example the rolls can also be leaned against one another in standing manner, a storage method which requires no pallets and which also requires no rotary movement on the part of the manipulation tool.

The inventive transfer mechanism and a forklift can also be used for storage processes such as are described in Swiss patent application 888/91 of the same Applicant between the winding station and the store in place of the transfer mechanism and shuttle vehicle described therein. However, the forklift must then deposit or receive the rolls and roll cores in front of the store on a further transfer location, where they would be collected or deposited by a special store tool. There is also no need in this case to carry the pallets.

Figure 10B:
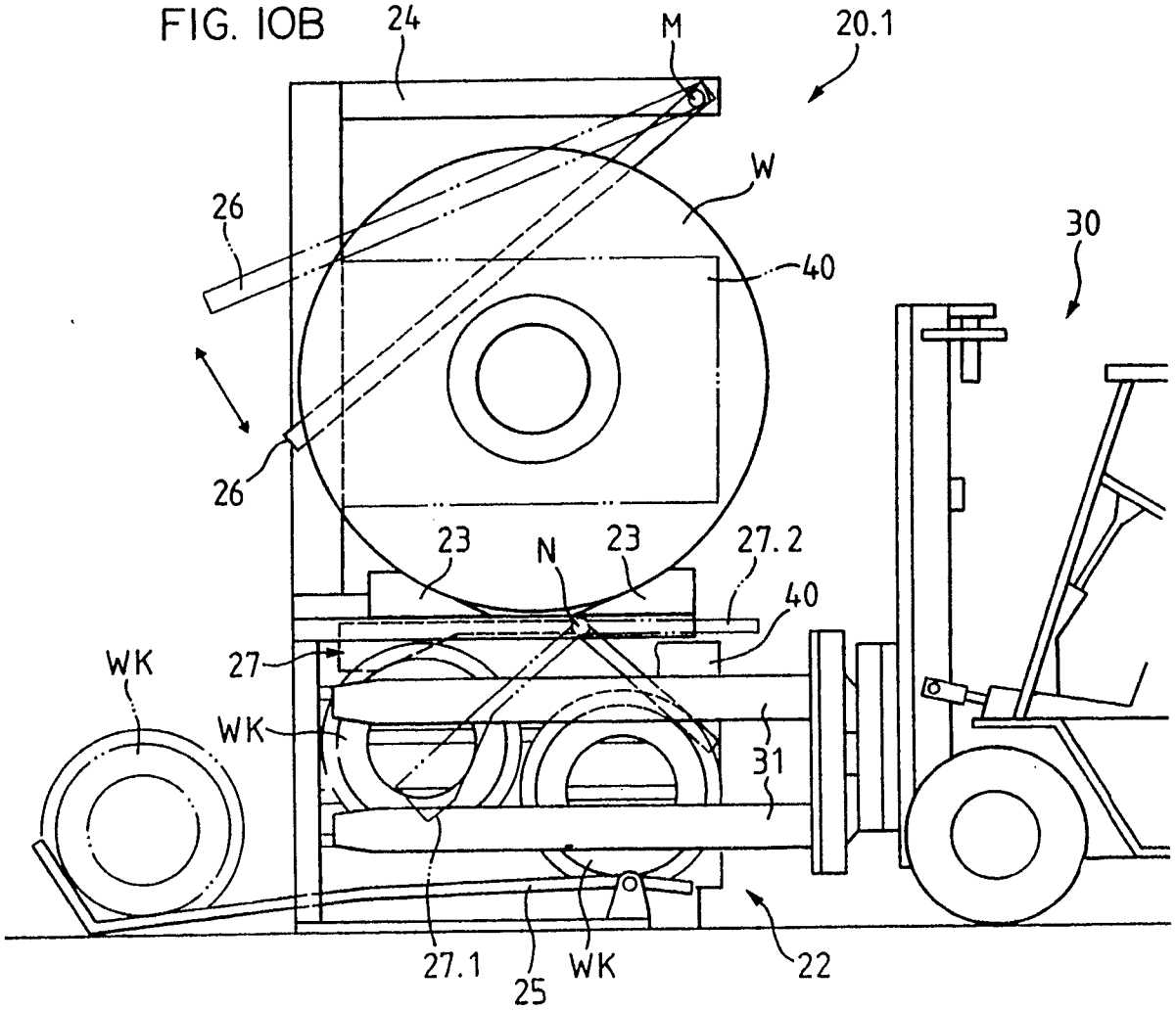
FIGS. 10A and 10B are front and side elevations, respectively, of an embodiment of a transfer mechanism for a winding-up station in accordance with the invention.
Figure 10A:
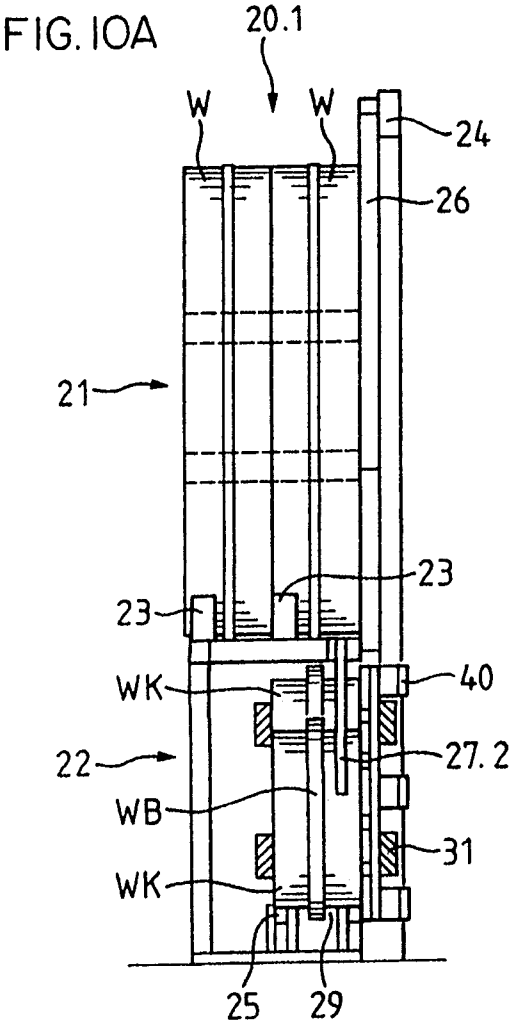
Figure 11B:
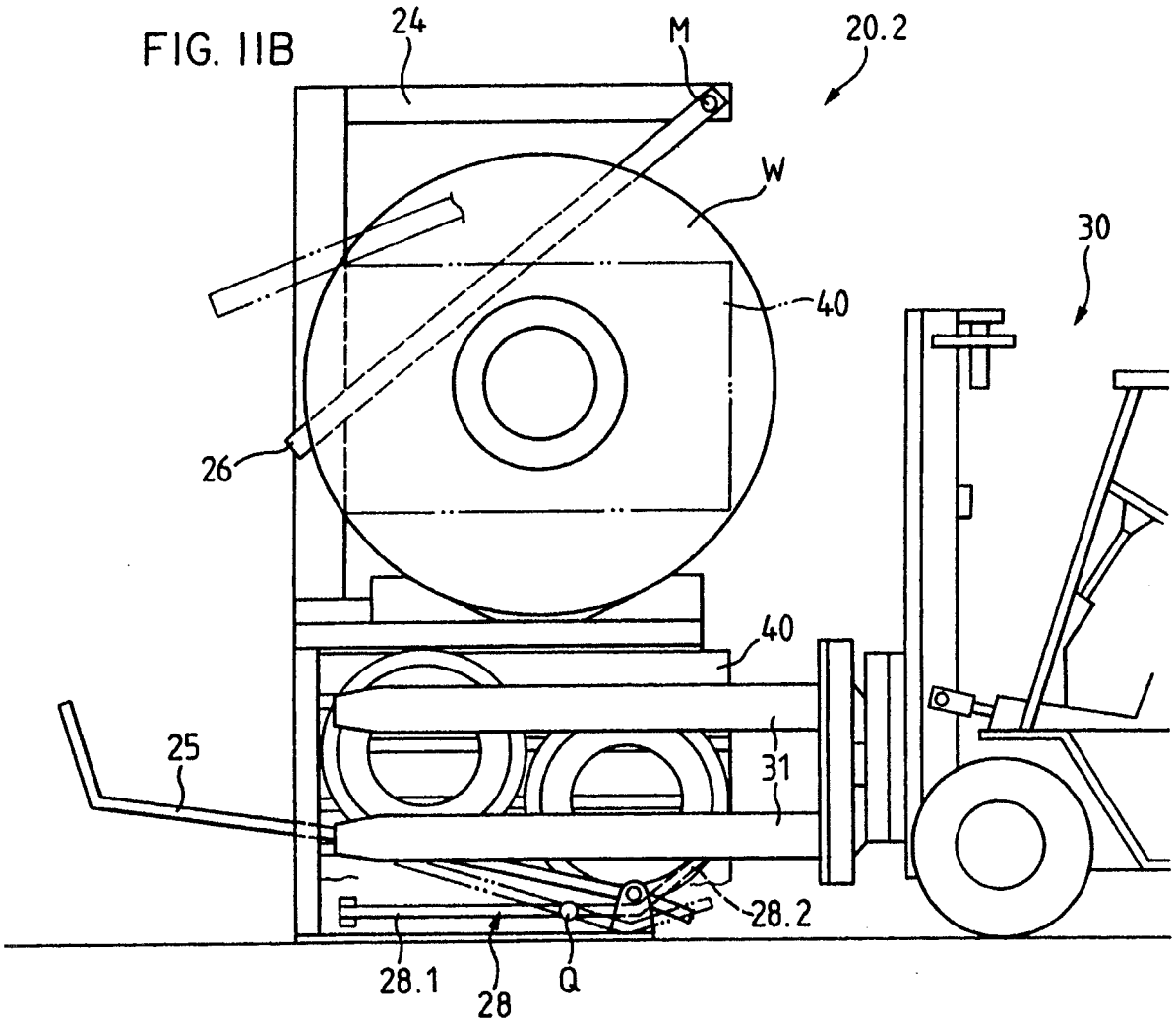
FIGS. 11A and 11B are front and side elevations, respectively, of an embodiment of a transfer mechanism for a winding-off station in accordance with the invention.

FIGS. 10A–B and 11A–B show in detail an embodiment of the transfer mechanism according to the invention, FIGS. 10B and 11B being side views similar to FIGS. 4 to 7 and FIGS. 10A and 11A being front views from the store side to which the article is moved by the manipulation/transportation vehicle. FIG. 10 shows the embodiment for cooperation with a winding-up station and FIG. 11 for that with a winding-off station. In both side views it is possible to partly see the manipulation/-transportation vehicle, which has just introduced roll cores in FIG. 10B and in FIG. 11B grips the roll cores for transporting away.

The two front views clearly show that the rolls W and roll cores WK are deposited on the roll location 21 and the core location 22 of the transfer mechanism 20.1 or 20.2. They show that in the same way single or plural roll or roll cores can be deposited. By a corresponding design of the core guide 25, a roll core would then be positioned centrally with respect to the pallet 40 and four cores, juxtaposed in pairs would be arranged in the represented manner. According to the process described up to now the cores are positioned centrally below the rolls and not on the side of the side support 24, as shown in FIGS. 10A–B and 11A–B. Only in the case of a central arrangement of the cores is it possible to use a forklift, whose forks are moved symmetrically against one another. A lateral arrangement, as shown in FIGS. 10A–B and 11A–B, requires a forklift with a quasi-stationary fork and a fork movable against the latter and such a forklift can easily be produced from a commercially available forklift. Only in the case of such asymmetrically movable forks can the inventive process be performed with asymmetrically deposited cores, without centrally moving the cores on gripping. Seen from the store side, the cores can either be deposited to the right, as shown, or to the left. If a forklift is to be able to serve transfer stations with right and left deposited cores, it must be able to rotate its manipulation tool in both directions, so that the pallet, which must be carried along on the quasi-stationary fork, always comes to rest at the bottom for storage purposes.

Figure 11A:
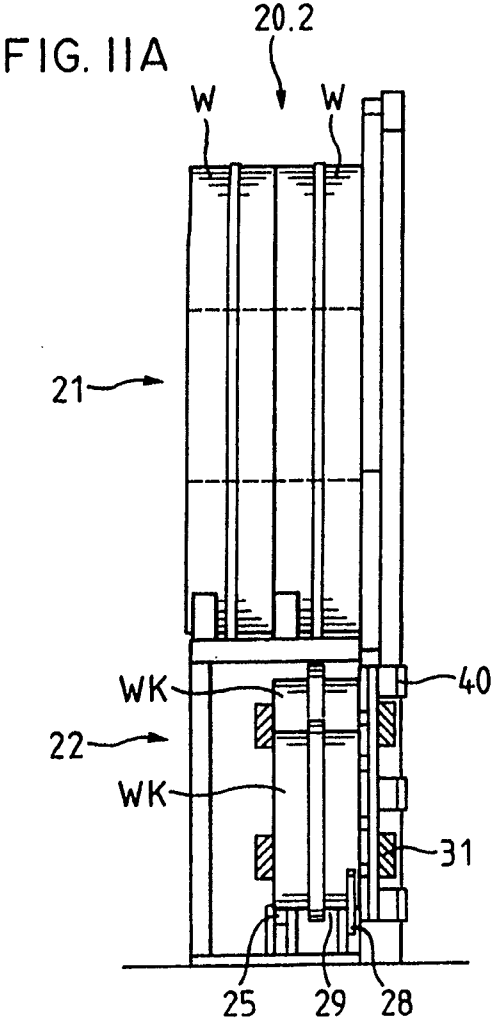

In the side views of FIGS. 10A–B and 11A–B are shown as further details a pivot lever 26, an upper pivot angle guide 27 (FIG. 10A–B) and a lower pivot angle guide 28 (FIG. 11A–B). The pivot lever 26 is pivotably arranged about a pivot axis 14 on the side support 24 in such a way that on introducing rolls with the pallet it is pivoted upwards (extended position), while on moving down the manipulation tool with the pallet it is pivoted downwards (broken line position) and therefore takes over part of the lateral supporting function, without coming into conflict with the inserting forks or pallet.

The upper pivot angle guide 27 at its bending point about a pivot axis N can be so pivotably fitted to the transfer mechanism 20.1 in the vicinity of the core location, that it can prevent an immediate rolling away of the cores when released from the grip of the forks. Such an upper pivot angle guide 27 is only appropriately used on a transfer mechanism 20.1 associated with a winding-up station (FIG. 10). Thus, without cores, the upper pivot angle guide 27 is pivoted by gravity into a position in which its roll station-side leg 27.1 is directed downwards, whereas its store-side leg 27.2 abuts against the transfer mechanism in a substantially horizontal position (dot-dash line position). The core guide 25 is inclined against the winding station. If cores are now introduced, the upper pivot angle guides 27 move in such a way that the roll station-side leg 27.1 assumes a substantially horizontal position and the store-side leg 27.2 is directed downwards (continuous line position). The two legs of the upper pivot angle guide 27 are shaped in such a way that in this position they prevent the rolling away of the two cores. The upper pivot angle guide 27 is locked in this position. If the cores are then required for the winding station, the locking action is released, so that the cores roll away against the winding station (dot-dash line position of a core) and the upper pivot angle guide 27 is pivoted back again into its inoperative position.

The lower pivot angle guide 27 serves as a store-side stop for the core guide 25, when the latter is inclined against the store side (for a winding-off station). It prevents cores rolling in the core location from rolling away against the manipulation/transportation vehicle, but pivoting away must be possible so that the cores can be transported away. A lower pivot angle guide 28 is appropriately used in a transfer mechanism 20.2 associated with a winding-off station (FIG. 11). The lower pivot angle guide 28 has a winding station-side leg 28.1 and a store-side leg 28.2. Between the legs it is pivotable about a pivot axis Q in the lower area of the core location, being arranged in such a way that in its one pivoting position (continuous line position) the store-side leg 28.2 can stop against cores rolling on the core guide 25 rising against the winding station and in its other pivoting position (broken line position) it does not impede the moving out of the cores. The lower pivot angle guide 28 can be locked in its stopping position for as long as cores are deposited on the core guide by the travelling crane. The locking action is released if the cores deposited in the core location are gripped by a manipulation tool and moved out. The cures are laterally guided in that the core guide 25 has a central slot 29, in which runs the winding band WB rolled centrally on the core.

All the drawings show the inventive transfer mechanism with the roll location at the top and the core location at the bottom, but a reversal of these positions would also be possible.

I claim:

1. A process for exchanging empty roll cores and printed product rolls on a winding-up station, each printed product roll comprising a roll core with printed products wound thereon, and for storing printed product rolls and empty roll cores in storage locations, the method comprising the steps of, with a first manipulation and transportation means, depositing empty roll cores on a winding-up station, removing printed product rolls from the winding-up station, transporting the printed product rolls to a stationary transfer location, the transfer location having a winding station side for exchange of printed product rolls and empty roll cores with a winding station and a storage side for exchange of printed product rolls and empty roll cores with a storage location and having a first position for printed product rolls and a second position for empty roll cores, and depositing the printed product rolls at the winding station side of the first position of the transfer location, and removing empty roll cores from the winding station side of the second position of the transfer location for transportation to the winding-up station;

providing a second manipulation and transportation means having a manipulation tool movable reciprocatingly along a path, the second manipulation and transportation means comprising a fork lift truck having two forks movable toward and away from each other and being movable together along the path, the forks being moved toward each other to clamp a printed product roll or empty roll core between the forks;

with the second manipulation and transportation means, depositing empty roll cores at the transfer location including separating the forks to release the roll cores, moving the forks along the path and then toward each other to clamp printed product rolls, transporting the rolls to the storage location, separating the forks to release the rolls at the storage location, and moving the forks together to clamp empty roll cores at the storage location, removing printed product rolls from the storage side of the transfer location, transporting and depositing printed product rolls at a storage location, and taking empty roll cores from the storage location for delivery to the transfer location, said first and second positions of the transfer location being disposed vertically relative to each other so that the manipulation tool of the second manipulation and transportation means need only move along said path from the first position to the second position to deposit empty rolls and remove printed product rolls at the transfer location.

2. A process according to claim 1 wherein the step of transporting includes carrying a selected number of printed product rolls or an equal number of empty roll cores.

3. A process according to claim 1 and including storing a predetermined number of printed product rolls on each of a plurality of pallets as full roll storage units, storing an equal predetermined number of empty rolls on each of a plurality of pallets as empty roll storage units, storing empty roll and full roll storage units at selected storage locations, and wherein the steps of depositing, removing, transporting and depositing, and removing with the first manipulation and transportation means are performed with storage units and include removing a pallet at the transfer location when empty roll cores are deposited at the transfer location, moving the pallet along the path, placing full roll storage units on the pallet, transporting the pallet and storage unit and storing the pallet as part of the storage unit.

4. A process according to claim 1 wherein said path is linear and substantially vertical.

5. A process for exchanging empty roll cores and printed product rolls on a winding-off station, each printed product roll comprising a roll core with printed products wound thereon, transferring and storing printed product rolls and empty roll cores in storage locations, the method comprising the steps of, with a first manipulation and transportation means, depositing printed product rolls on a winding-off station, removing empty roll cores from the winding-off station, transporting the empty roll cores to a stationary transfer location, the transfer location having a winding station side for exchange of printed product rolls and empty roll cores with a winding station and a storage side for exchange of printed product rolls and empty roll cores with a storage location and having a first position for printed product rolls and a second position for empty roll cores, and depositing the empty roll cores at the winding station side of the second position of the transfer location, and removing printed product rolls from the winding station side of the first position of the transfer location for transportation to the winding-off station;

providing a second manipulation and transportation means having a manipulation tool movable reciprocatingly along a path, the second manipulation and transportation means comprising a fork lift truck having two forks movable toward and away from each other and movable together along the path, the forks being moved toward each other to clamp a printed product roll or empty roll core between the forks;

with the second manipulation and transportation means, depositing printed product rolls at the transfer location including separating the forks to release the printed product rolls, moving the forks along the path and then toward each other to clamp empty roll cores, transporting the roll cores to the storage location, separating the forks to release the roll cores at the storage location, and moving the forks together to clamp printed product rolls at the storage location, removing empty roll cores from the storage side of the transfer location, transporting and depositing empty roll cores at a storage location, and taking printed product rolls from the storage location for delivery to the transfer location, said first and second positions of the transfer location being disposed vertically relative to each other so that the manipulation tool of the second manipulation and transportation means need only move along said path from the first position to the second position to deposit printed product rolls and remove empty roll cores at the transfer location.

6. A process according to claim 5 wherein the step of transporting includes carrying a selected number of printed product rolls or an equal number of empty roll cores.

7. A process according to claim 5 and including storing a predetermined number of printed product rolls on each of a plurality of pallets as full roll storage units, storing the same predetermined number of empty rolls on each of a plurality of pallets as empty roll storage units, storing empty roll and full roll storage units at selected storage locations, transporting a full roll storage unit to the transfer location, and wherein the steps of depositing, removing, transporting and depositing, and removing are performed with storage units and include removing a pallet at the transfer location when printed product rolls are deposited at the transfer location, moving the pallet along the path, placing empty roll storage units on the pallet, transporting the pallet and storage unit and storing the pallet as part of the storage unit.

8. A process according to claim 5 wherein said path is linear and substantially vertical.

9. An apparatus for exchanging printed product rolls and empty roll cores on a winding-up station, each printed product roll comprising a roll core with printed products wound thereon, and for storing printed product rolls and empty roll cores in storage locations, the apparatus comprising the combination of a first manipulation and transportation means for depositing empty roll cores at a winding-up station, removing printed product rolls from said winding-up station, and transporting said printed product rolls to a stationary transfer location;

a transfer station at said transfer location, said having a winding station side for exchange of printed product rolls and empty roll cores with a winding station and a storage side for exchange of printed product rolls and empty roll cores with a storage location and having a first position for printed product rolls and a second position for empty roll cores, said first manipulation and transportation means depositing the printed product rolls at said winding station side of said first position of said transfer location; and a second manipulation and transportation means having a manipulation tool movable reciprocatingly along a path for removing printed product rolls from said storage side of said transfer station, transporting printed product rolls and depositing said printed product rolls at a storage location, and delivering empty roll cores from said storage location to said transfer;

said first and second positions of said transfer location being located one vertically over the other so that said manipulation tool of said second manipulation and transportation means need only move vertically along said path from said first position to said second position to deposit empty rolls and remove printed product rolls at said transfer location.

10. An apparatus according to claim 9 wherein said path is linear.

11. An apparatus according to claim 10 wherein said transfer mechanism includes holding means at said first position for holding a plurality of printed product rolls with horizontal rotation axes located in substantially a single vertical plane, and said second location includes means for supporting a plurality of empty roll cores equal in number to the plurality of printed product rolls in said first position.

12. An apparatus according to claim 11 wherein said holding means at said first position and said means for supporting at said second position are relatively located so that a front face of said plurality of printed product rolls and a front face of said empty roll cores lie in substantially the same plane.

13. An apparatus according to claim 12 wherein said printed product rolls and said empty roll cores each have a plane of symmetry perpendicular to said rotation axes, and wherein said plane of symmetry of said empty roll cores lies in substantially the same plane as said plane of symmetry of one of said printed product rolls.

14. An apparatus according to claim 11 wherein said holding means includes oppositely inclined wedges holding said rolls therebetween, a lateral support and a pivot lever for retaining said rolls.

15. An apparatus according to claim 14 wherein said means for supporting includes an inclined core retainer projecting out of said transfer mechanism.

16. An apparatus according to claim 15 wherein said means for supporting further includes a pivotable angled guide contacting said empty roll cores to control rolling thereof.

17. An apparatus for exchanging printed product rolls and empty roll cores on a winding-off station, each printed product roll comprising a roll core with printed products wound thereon, and for storing printed product rolls and empty roll cores in storage locations, the apparatus comprising the combination of a first manipulation and transportation means for depositing printed product rolls at a winding-off station, removing empty roll cores from said winding-off station, and transporting said empty roll cores to a stationary transfer location;

a transfer station at said transfer location, said station having a winding station side for exchange of printed product rolls and empty roll cores with a winding station and a storage side for exchange of printed product rolls and empty roll cores with a storage location and having a first position for printed product rolls and a second position for empty roll cores, said first manipulation and transportation means depositing the empty roll cores at said winding station side of said first position of said transfer location, and a second manipulation and transportation means having a manipulation tool movable reciprocatingly along a path for removing empty roll cores from said storage side of said transfer station, depositing printed product rolls at said transfer station, transporting and depositing empty roll cores at a storage location, and delivering printed product rolls from said storage location to said transfer station;

said first and second positions of the transfer location being located one vertically over the other so that said manipulation tool of said second manipulation and transportation means need only move along said path from said first position to said second position to deposit printed product rolls and remove empty roll cores at said transfer location.

18. An apparatus according to claim 17 wherein said path is linear.

19. An apparatus according to claim 18 wherein said transfer mechanism includes holding means at said first position for holding a plurality of printed product rolls with horizontal rotation axes located in substantially a single vertical plane, and said second location includes means for supporting a plurality of empty roll cores equal in number to the plurality of printed product rolls in said first position.

20. An apparatus according to claim 19 wherein said holding means at said first position and said means for supporting at said second position are relatively located so that a front face of said plurality of printed product rolls and a front face of said empty roll cores lie in substantially the same plane.

21. An apparatus according to claim 20 wherein said printed product rolls and said empty roll cores each have a plane of symmetry perpendicular to said rotation axes, and wherein said plane of symmetry of said empty roll cores lies in substantially the same plane as said plane of symmetry of one of said printed product rolls.

22. An apparatus according to claim 19 wherein said holding means includes oppositely inclined wedges holding said rolls therebetween, a lateral support and a pivot lever for retaining said rolls.

23. An apparatus according to claim 22 wherein said means for supporting includes an inclined core retainer projecting out of said transfer mechanism.

* * * * *